US006306071B1

(12) United States Patent
Tomic

(10) Patent No.: US 6,306,071 B1
(45) Date of Patent: Oct. 23, 2001

(54) RESEALABLE CLOSURE MECHANISM HAVING A SLIDER DEVICE WITH FLEXIBLE SIDEWALLS

(75) Inventor: Mladomir Tomic, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/464,905

(22) Filed: Dec. 16, 1999

(51) Int. Cl.[7] ..... B31B 1/84

(52) U.S. Cl. ..... 493/213; 493/214; 493/114; 493/393; 493/927

(58) Field of Search ..... 493/214, 114, 493/213, 308, 325, 393, 927; 24/400, 399, 587, 576

(56) References Cited

U.S. PATENT DOCUMENTS

| | | | | |
|---|---|---|---|---|
| D. 325,547 | | 4/1992 | Saito et al. . | |
| 3,430,329 | | 3/1969 | Ausnit . | |
| 3,790,992 | | 2/1974 | Herz . | |
| 5,010,627 | | 4/1991 | Herrington et al. . | |
| 5,211,482 | * | 5/1993 | Tilman | 493/214 |
| 5,283,932 | * | 2/1994 | Richardson et al. | 24/400 |
| 5,301,394 | | 4/1994 | Richardson et al. . | |
| 5,442,838 | | 8/1995 | Richardson et al. . | |
| 5,638,586 | | 6/1997 | Malin et al. . | |
| 5,664,299 | | 9/1997 | Porchia et al. . | |
| 5,947,603 | * | 9/1999 | Tilman | 493/214 |
| 5,983,466 | | 11/1999 | Petkovsek . | |
| 6,178,602 | * | 1/2001 | Burke et al. | 24/400 |

FOREIGN PATENT DOCUMENTS 1 277 607 9/1968 (DE) .

* cited by examiner

*Primary Examiner*—Peter Vo
*Assistant Examiner*—Sam Tawfik
(74) *Attorney, Agent, or Firm*—Thomas R. Trempus; Edward L. Levine

(57) ABSTRACT

A single-piece slider device for use with resealable closure mechanisms having a first closure profile and a second closure profile is provided. The slider device includes a rigid top wall, at least a first plow for separating the first and second closure profiles, a first sidewall, and a second sidewall. The first and second sidewalls each have an inner surface, an outer surface, a bottom edge, and a length. The first sidewall has a first flex point arranged and configured to allow the first sidewall to flex at the first flex point. The second sidewall has a second flex point arranged and configured to allow the second sidewall to flex at the second flex point. The flexpoints can be notches on the outer portions or inner portions of the sidewalls, between the top wall and the sidewalls, or between the sidewalls and the bottom portions. The top wall can have depending tabs to help align the slider device with the profiles. Further embodiments include guide rails and tracks on the profiles and sidewalls, sloped surfaces on the profiles and sidewalls, surface ridges, an opening in the top wall of the slider device, and a secondary closure mechanism. Methods of construction are described.

32 Claims, 9 Drawing Sheets

RESEALABLE CLOSURE MECHANISM HAVING A SLIDER DEVICE WITH FLEXIBLE SIDEWALLS

FIELD OF THE INVENTION

The present invention generally relates to closure arrangements for polymer packages, such as, plastic bags. In particular, the present invention relates to resealable closure mechanisms or zipper-type closures for resealable packages.

BACKGROUND

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. As such. providing products in resealable packages appreciably enhances the marketability of those products.

Some types of resealable packages are opened and closed using a slider device. The slider device typically includes a separator or plow-type structure at one end that opens a closure mechanism, having profiled elements or closure profiles, when the slider device travels in a first direction along the mechanism. The sidewalls of the slider device are inwardly tapered from one end to the opposite end so that the sidewalls engage the closure profiles and progressively move them into engagement to close the resealable package when the slider device is moved along the closure mechanism in a direction opposite the first direction.

Concerns are raised regarding resealable closure mechanisms with slider devices. One such concern is attachment of the slider device to the package. For example, rigid slider devices can be difficult to attach to the package, and multiple piece slider devices require additional manufacturing steps. Not only do both of these alternatives involve additional costs, but they also result in lower manufacturing rates. Improvements are desirable.

SUMMARY OF THE INVENTION

In one aspect of the present invention, one example embodiment involves a single-piece slider device for use with a resealable closure mechanism having a first closure profile and a second closure profile. The slider device includes a rigid top wall, at least a first plow depending from the top wall for separating the first and second closure profiles, a first sidewall, and a second sidewall. Each of the first and second sidewalls has an inner surface, an outer surface, a bottom edge, and a first length. The first sidewall has a first flex point configured to allow a first portion of the first sidewall to flex at the first flex point. The second sidewall has a second flex point configured to allow a first portion of the second sidewall to flex at the second flex point.

In another aspect, another embodiment of the present invention involves a closure arrangement for use with a package having a plurality of edges. The closure arrangement includes a first closure profile, a second closure profile, and a slider device. The first and second closure profiles both include a base strip and an interlocking closure member. The interlocking closure members of the first and second closure profiles are arranged and configured to selectively engage. The slider device can include structures described herein.

Yet another embodiment of the present invention involves a resealable package. The resealable package has first and second panel sections joined together to define an enclosed region and a mouth providing access to the enclosed region. The resealable package also has a closure arrangement secured to the first and second panel sections for selectively opening and sealing the mouth. The closure arrangement can include structures, including slider devices, as described herein.

In yet another embodiment of the present invention, a method of attaching a single-piece slider device having a rigid top wall is provided. The method includes a step of providing a package having a resealable closure mechanism. A slider device is placed over the closure mechanism and aligned therewith. Next, the slider device is pushed onto the closure mechanism causing the sidewalls of the slider device to spread apart no greater than 30 degrees from a vertical line through a center of the top wall to encapsulate the closure mechanism.

In yet another embodiment of the present invention, a method of sealing a resealable package is provided. The method includes a step of providing a package having first and second opposite side edges, a resealable mouth between the first and second side edges, a first resealable closure mechanism with a slider thereover for opening and resealing the mouth, and a second closure mechanism outside of the slider device for sealing the mouth. The slider device is moved along the mouth in a first direction from the second side, encapsulating the first closure mechanism and not encapsulating the second closure mechanism, to interlock the first closure mechanism and to interlock the second closure mechanism.

The above summary of principles of the present invention is not intended to describe each illustrated embodiment or every implementation of the present invention. The figures and the detailed description that follow more particularly exemplify these embodiments.

BRIEF DESCRIPTION OF THE DRAWINGS

Principles of the invention may be more completely understood in consideration of the detailed description of various embodiments of the invention that follows in connection with the accompanying drawings in which.

Figure 1:
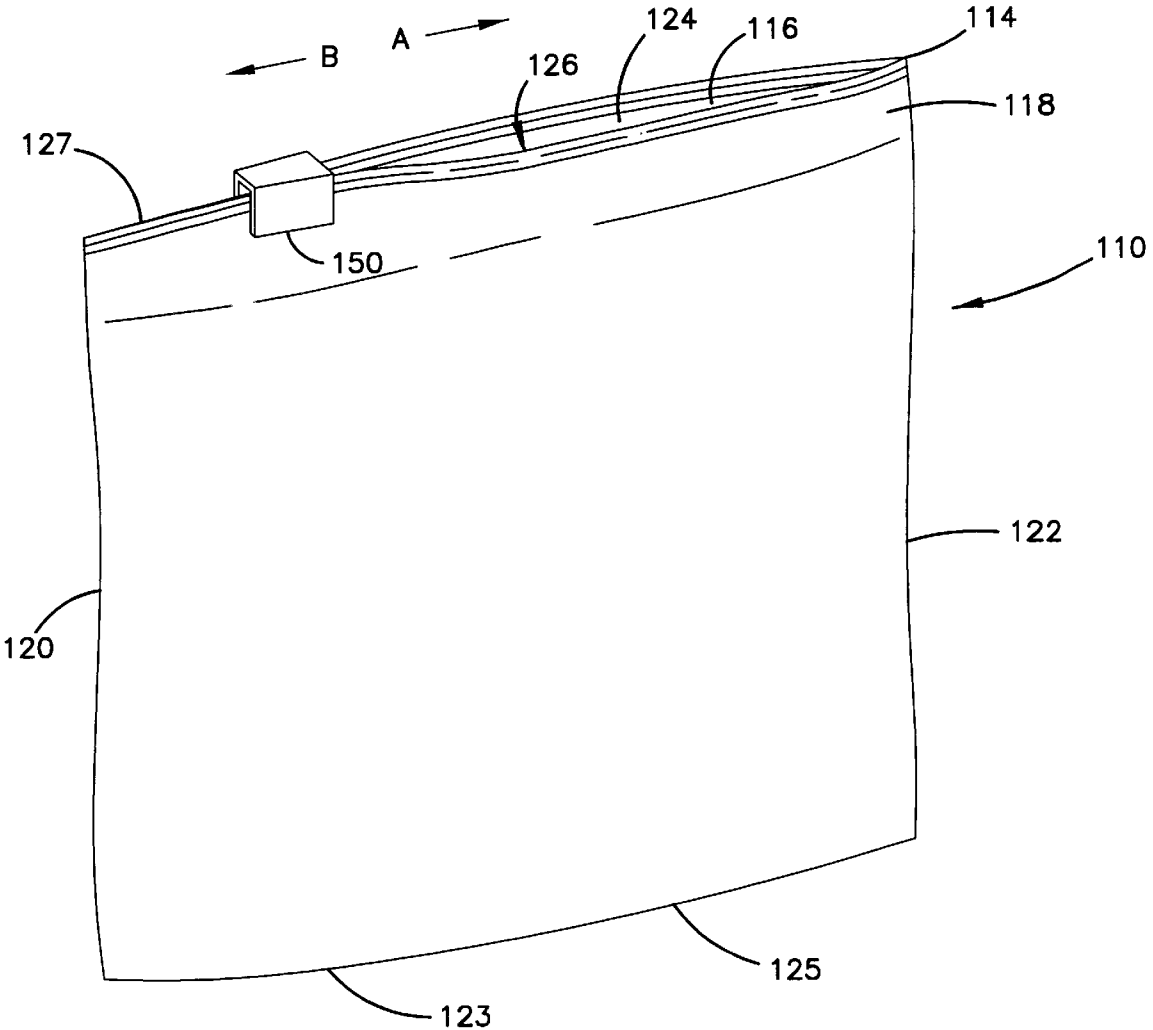
FIG. 1 is a perspective view of a flexible, resealable package having a slider device, according to an example embodiment of the present invention.

While principles of the invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

The present invention is believed to be applicable to a variety of packaging arrangements. An appreciation of various aspects of the invention is best gained through a discussion of an example for such a packaging arrangement.

According to an example embodiment of the present invention, a slider device has flexible sidewalls that allow the slider device to be easily attached to a package. FIG. 1 illustrates an example type of package 110 that benefits from the use of the present invention.

Attention is directed to FIG. 1. FIG. 1 illustrates an example packaging arrangement in the form of a resealable, flexible package 110, for example, a polymer package such as a plastic bag, having a resealable closure mechanism 114, for example, interlocking profiled elements, constructed in accordance with the present invention. The flexible package 110 includes first and second opposed panel sections 116, 118, typically made from a flexible, polymer, plastic film. For some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at the top edge 127 of the package. In the particular embodiment shown, the mouth 126 extends the width of the package 110.

The resealable closure mechanism 114 is illustrated in FIG. 1 at the mouth 126 of the flexible package 110. In the embodiment shown, the resealable closure mechanism 114 extends the width of the mouth 126. Alternatively, the closure mechanism 114 could be positioned on the package 110 at a location different from the mouth 126 of the package 110, depending on the application needs for the package 110. The resealable closure mechanism 114 can be one of a variety of closure mechanisms. In the particular embodiment illustrated in FIG. 2, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
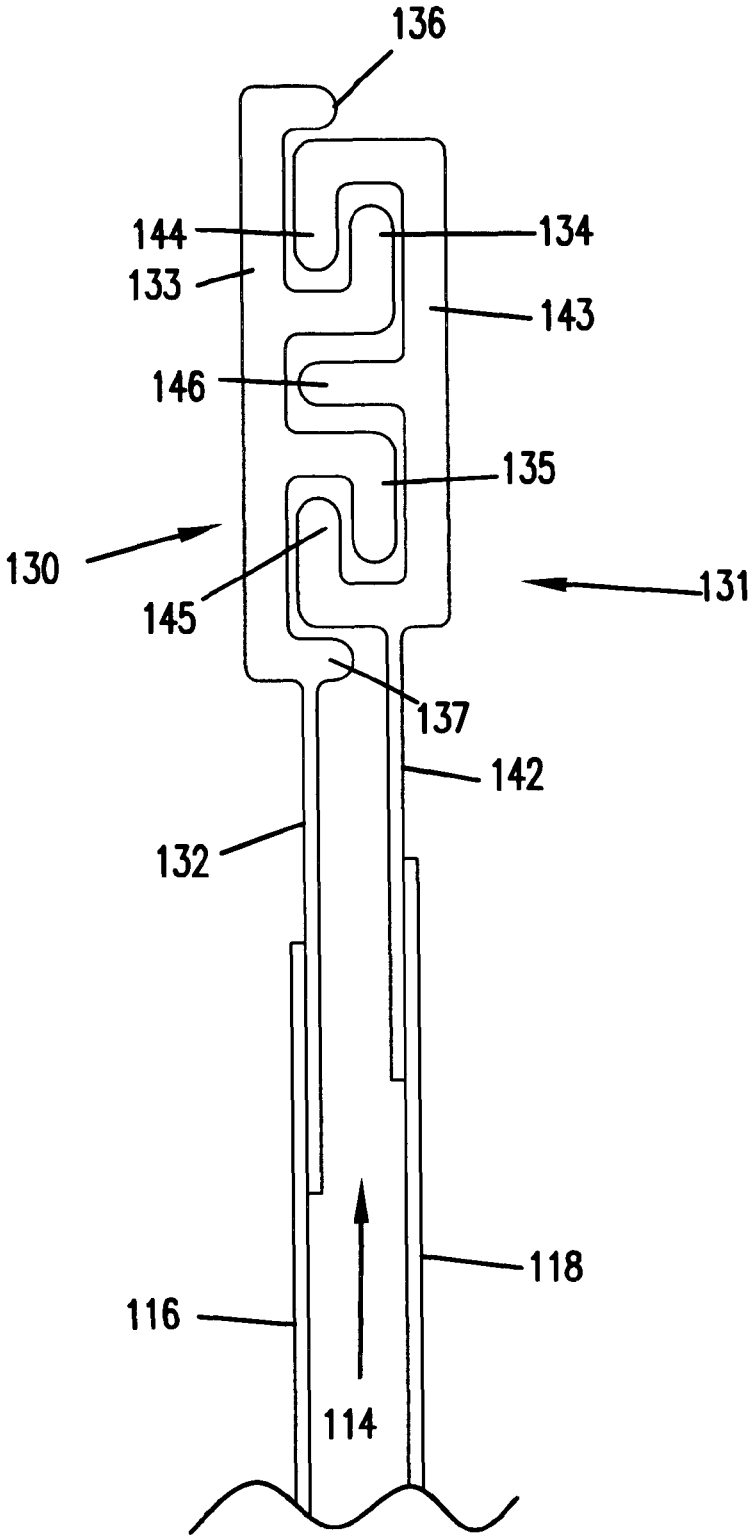
FIG. 2 is a fragmented, cross-sectional view of profiled elements secured to a flexible package, according to an example embodiment of the present invention.

In particular, the zipper-type closure mechanism in FIG. 2 is an illustration of one example of a multi-track closure mechanism 114. By "multi-track," it is meant that each profile has two or more pairs of hooks or members for interlocking or interengaging. The closure mechanism 114 includes an elongated first closure profile 130 and an elongated second closure profile 131. Typically, the closure profiles 130, 131 are manufactured separately from each other. Alternatively, any simple or complex closure mechanism could be used, for example, a mono-track mechanism.

Still in reference to FIG. 2, the first closure profile 130 includes a bonding strip 132, a base strip 133, first and second closure members 134, 135, and first and second guide posts 136, 137. The closure members 134, 135 extend from the base strip 133 and are generally projecting from the base strip 133. The guide posts 136, 137 also extend from the base strip 133 and are generally projecting from the base strip 133. The guide posts 136, 137 aid in holding the closure mechanism 114 closed and in aligning the first closure profile 130 with the second closure profile 13I1 for interlocking. The bonding strip 132 depends or extends downward from the second guide post 137 and is attached to a first panel section, such as the first panel section 116 of the package 110 of FIG. 1.

The second closure profile 131 likewise includes a bonding strip 142, a base strip 143, first and second closure members 144, 145, and a guide post 146. The closure members 144, 145 extend from the base strip 143 and are generally projecting from the base strip 143. The guide post 146 also extends from the base strip 143 and is generally projecting from the base strip 143. The guide post 146 aids in holding the closure mechanism 114 closed and aids in aligning the second closure profile 131 with the first closure profile 130 for interlocking. The bonding strip 142 depends or extends downward from the second interlocking closure member 145 and is attached to a second panel section, such as the second panel section 118 of the package 110 of FIG. 1.

The first and second closure profiles 130, 131 are designed to engage with one another to form a resealable closure mechanism 1 14. The closure members 134, 135 of the first closure profile 130 extend from the base strip 133 a certain distance. The closure members 144, 145 of the second closure profile 131 also extend from the base strip 143, a certain distance. These certain distances, that the closure members 134, 135, 144, 145 extend, are sufficient to allow mechanical engagement, or interlocking, between the first closure member 134 of the first closure profile 130 and the first closure member 144 of the second closure profile 131. Likewise, the second closure member 135 of the first closure profile 130 and the second closure member 145 of the second closure profile 131 mechanically engage, or interlock, with each other. The guide posts 136, 137, 146 aid in aligning the profiles 130, 131 and in keeping the profiles 130, 131 interlocked. Furthermore, the closure profiles 130, 131 are sealed together at their ends, such as side edges 120, 122 of FIG. 1, to further aid in aligning the closure profiles 130, 131 for interlocking. Pressure is applied to the closure profiles 130, 131 as they engage to form the openable sealed closure mechanism 114. Pulling the first closure profile 130 and the second closure profile 131 away from each other causes the two closure profiles 130, 131 to disengage, opening the package 110 of FIG. 1. This provides access to the contents of the package 110 through the mouth 126 (FIG. 1).

In some applications, the closure profiles 130, 131 are formed by two separate extrusions or through two separate openings of the common extrusion. Typically, the resealable closure mechanism 114 is made of a polymer. plastic material, such as polyethylene or polypropylene. In one example embodiment, the closure arrangement illustrated in FIG. 2 is manufactured using conventional extrusion and heat sealing techniques.

Figure 3:
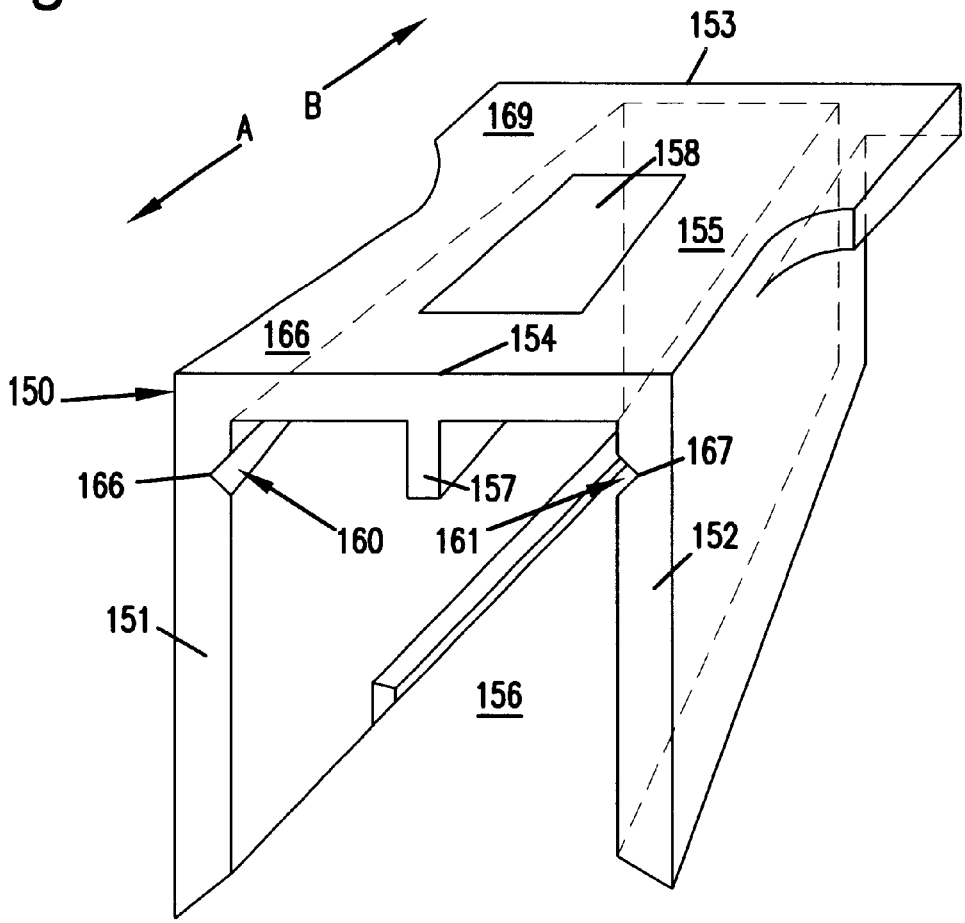
FIG. 3 is a perspective view of an enlarged slider device, according to an example embodiment of the present invention.

Referring back to FIG. 1, a slider device 150 opens and closes the resealable closure mechanism 114. Attention is directed to FIG. 3. The slider device 150 has first and second sidewalls 151, 152, a first end 153, a second opposite end 154, and a rigid top wall 155 extending between the first and second sidewalls 151, 152. By "rigid," it is meant that the top wall 155 is stiff and relatively inflexible. The sidewalls 151, 152 define a cavity 156 that receives the first and second closure profiles 130, 131 (FIG. 2). The slider device 150 further has a separator or plow 157. In the embodiment shown, the plow 157 depends or extends down from the top wall 155 of the slider device 150 into the cavity 156. In preferred embodiments, the plow 157 is located at the second end 154 of the slider device 150 and extends only partially along the length of the slider device 150. That is, the plow 157 only extends approximately 30 to 50% of the length of the slider device 150 beginning at the second end 154. The plow 157 does not exist at the first end 153 of the slider device 150.

The slider device 150 also has an opening or window 158. The window facilitates manufacturing of the slider device 150 by allowing a device (not shown) to be inserted through the window 158 to remove the slider device 150 from a conventional injection mold. Alternatively, the slider device 150 could have more than one opening or window.

Confronting portions of the sidewalls 151, 152 are tapered towards each other from the second end 154 towards the first end 153. Thus, referring back to FIG. 1, when the slider device 150 is moved in a first, sealing direction A along the top edge 127 of the package 110, the tapered shapes of the sidewalls 151, 152 (FIG. 3) of the slider device 150 apply pressure to the closure profiles 130, 131 (FIG. 2), pinching them together behind the slider device 150 as the slider device 150 moves forward. Interlocking the closure profiles 130,131 of the resealable closure mechanism 114 seals the mouth 126 of the package 110, preventing the contents of the package 110 from spilling out.

The plow 157 (FIG. 3) separates the closure profiles 130, 131 (FIG. 2) when the slider device 150 is moved in a second, opposite, opening direction B along the top edge 127 of the package 110. The plow 157 forces the closure profiles 130, 131 apart, providing access to the contents of the package 110 through the mouth 126.

Still in reference to FIG. 1, generally, to seal the package 110, a package user slides the slider device 150 in the scaling direction A across the top of the package 110. The tapered sidewalls 151, 152 (FIG. 3) apply pressure to the closure profiles 130, 131 interlocking them as the slider device 150 travels in the sealing direction A. When the slider device 150 is proximate to the side edge 122, the mouth 126 of the package 110 is sealed closed. Generally to open the package 110, the package user slides the slider device 150 in the opposite, opening direction B. The plow 157 (FIG. 3) separates the closure profiles 130, 131, opening the resealable closure mechanism 114.

Figure 4:
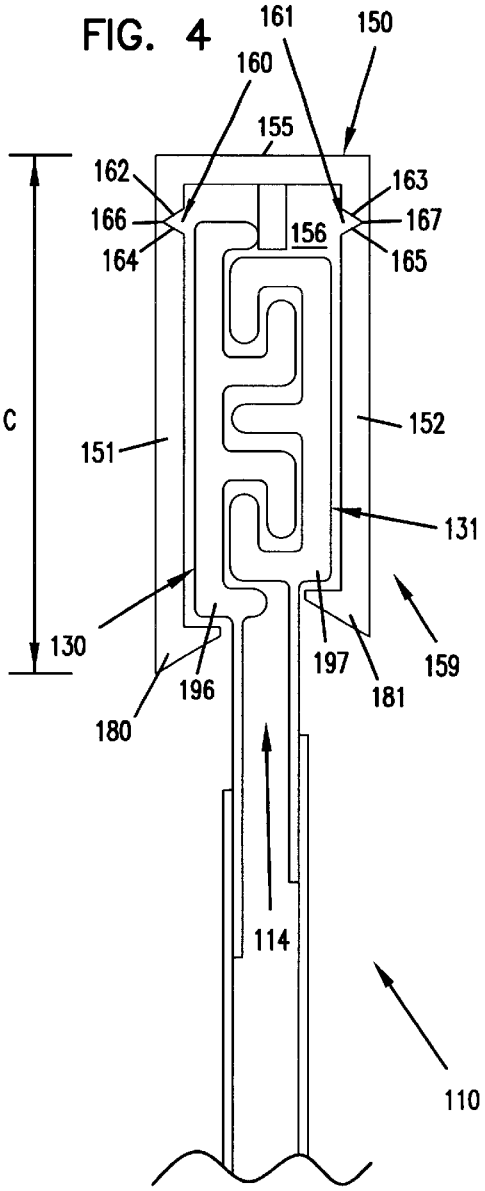
FIG. 4 is a back elevational view of the slider device of FIG. 3 engaging interlocked profiled elements, according to an example embodiment of the present invention.

Attention is directed to FIG. 4. FIG. 4 is a back elevational view of the slider device 150 of FIG. 3 engaged over the closure mechanism 114. The slider device 150 is designed to allow for easy assembly when mounted onto the closure mechanism 114. In general, the slider device 150 includes a flexibility system 159 to allow for flexing of the slider device 150 over the closure mechanism 114. The slider device 150 is convenient because it is a single, unitary, integral piece, avoiding the expense and complexity of multi-part, such as hinged, sliders. The single, unitary structure allows for assembly of the slider device 150 onto the closure mechanism 114 in a single step. The single piece design of the slider device 150 eliminates losing individual slider pieces during assembly. The flexibility system is particularly advantageous for slider devices having slider legs shorter than 0.25". For slider devices having slider legs longer than 0.25", the flexibility system 159 may include the longer slider legs having a greater flexibility.

In the embodiment illustrated in FIG. 4, the flexibility system of the slider device 150 includes first and second cut-outs or notches 160, 161 defined by the first and second walls 151, 152, respectively. The first and second notches 160, 161 are located within the cavity 156 of the sidewalls 151, 152, respectively, towards the top wall 155 of the slider device 150. The first and second notches 160, 161 have first and second top edges 162, 163, respectively, and first and second bottom edges 164, 165, respectively. The notches 160, 161 are generally elongated grooves extending the length of the first and second walls 151, 152, preferably, completely between the first end 153 (FIG. 3) and the second end 154 (FIG. 3) of the slider device 150. Preferably, the notches 160, 161 define triangular cross-sections with the first and second top edges 162, 163 being angled toward the top wall 155 of the slider device 150 and the first and second bottom edges 164, 165 being angled downwards toward the package 110. The notches 160, 161 reduce the thickness of the sidewalls 151, 152, respectively, of the slider device 150.

The first and second notches 160, 161, and correspondingly reduced thickness of the sidewalls 151, 152, form first and second flex points 166, 167, respectively, in the sidewalls 151, 152, respectively. The notches 160, 161 allow the respective sidewalls 151, 152 to flex or bend at flex points 166, 167. During assembly of the package 110, the sidewalls 151, 152 are pushed outward (that is, away from each other), flexing at flex points 166, 167, to allow the slider device 150 to be placed over the first and second closure profiles 130, 131. Once the slider device 150 is in place around the closure profiles 130, 131, the sidewalls 151, 152 revert back to their natural position, approximately normal to the top wall 155 of the slider device 150. No extra structure, pieces, or steps are required. In other words, the flex points 166, 167 have sufficient flexibility to allow for easy assembly over the closure mechanism 114, but also, sufficient rigidity to snap into place over the closure mechanism 114, once the force on the sidewalls 151, 152 is released.

Alternatively, the notches 160, 161 could be one of a variety of shapes and could be placed at any location along the sidewalls 151, 152, respectively. Of course, the closer towards the top wall 155 of the slider device 150 that the notches 160, 161 are placed, the greater the ease of assembly because the sidewalls 151, 152 can be pushed out further at their ends to fit over the closure profiles 130. 131 and because less force is required to push the sidewalls 151, 152 out. Similarly, the lengths C. D of the sidewalls 151, 152. respectively, affect the flexibility of the sidewalls 151, 152. For example, in the embodiment illustrated in FIG. 4, the first sidewall 151 has a length C that is greater than the length D of the second sidewall 152. The longer length C of the first sidewall 151 creates more torque on the first flex point 166 than the shorter length D of the second sidewall 152 creates on the second flex point 167. Accordingly, the first sidewall 151 will flex or bend more easily than the second sidewall 152. Preferably, the lengths C, D of the sidewalls 151, 152, respectively, correspond to the shape and size of the closure profiles 130, 131, creating a tight or snug fit of the slider device 150 over the closure profiles 130, 131. Preferably, the length C of the first sidewall 151 is about 5–15% greater than the length D of the second sidewall 152 and typically is about 8% greater. Furthermore, increasing the depth of the notches 160, 161 relative to the thickness of the sidewalls 151, 152 increases the flexibility of the sidewalls 151, 152, respectively.

Referring back to FIG. 3, the slider device 150 is shaped to facilitate opening and closing of the resealable closure mechanism 114 (FIG. 4). As shown in FIG. 3, the shape of the top wall 155 of the slider device 150 can be contoured to provide grasping regions 168, 169 for the consumer to use to move the slider device 150 forward and backward along the resealable closure mechanism 114, opening and closing the resealable closure mechanism 114. The contours include an angled out region 168 and a curved ledge region 169. The user would be able to grasp the slider device 150 along the angled out region 168, using ledge region 169 as a backstop. The top wall 155 of the slider device 150 is contoured above the notches 160, 161. Thus, the contouring does not affect the operation of the flex points 166, 167. Alternatively, the contouring could be done on the outside wall surfaces of the slider device 150.

Figure 5:
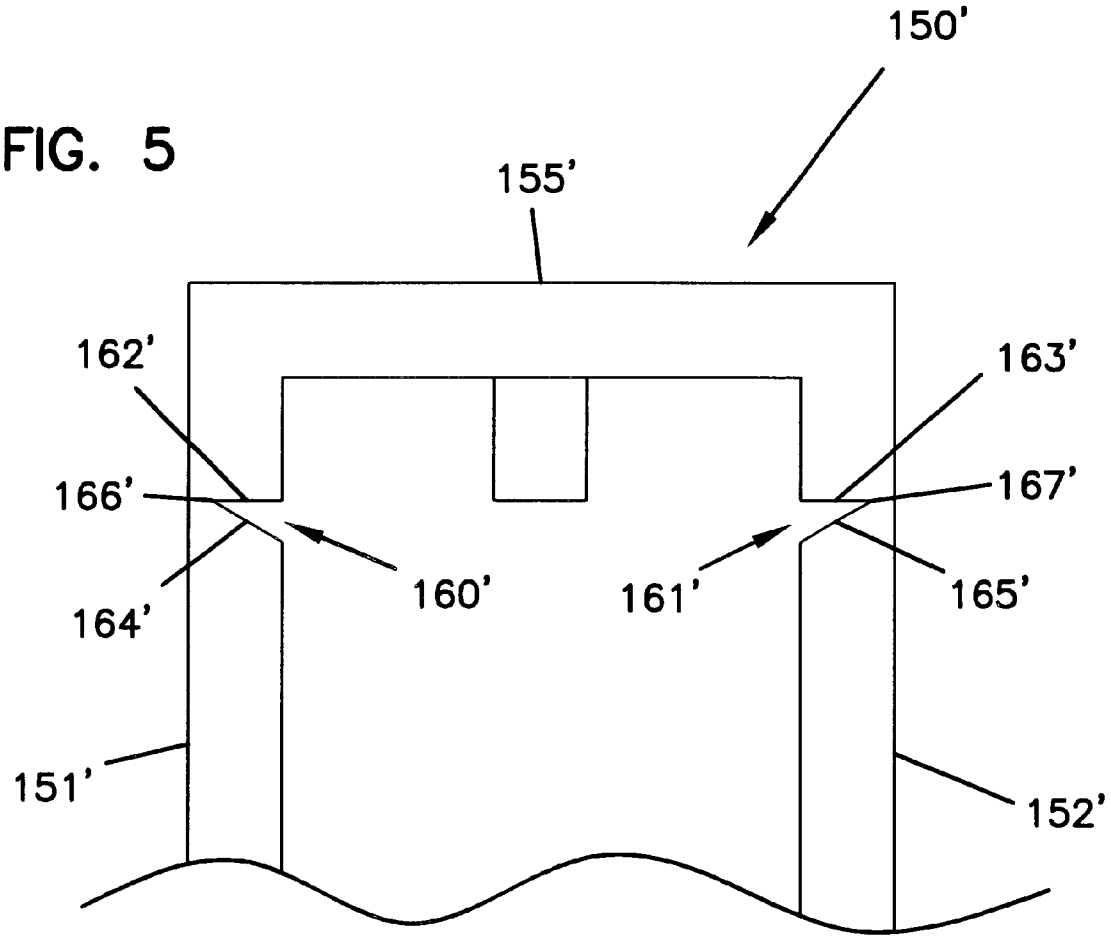
FIG. 5 is an enlarged, fragmented, back elevational view of an alternate slider device , according to an example embodiment of the present invention.

Referring back to FIG. 4, the angle between the top edges 162, 163 and the bottom edges 164, 165, respectively, affects how far the sidewalls 151, 152 can move away from the closure profiles 130, 131. For example, attention is directed to FIG. 5. In this particular embodiment, the distance of travel of the sidewalls 151', 152' is limited by the angle of the top edges 162', 163', respectively. As shown in FIG. 5, the top edges 162', 163' are parallel to the top wall 155' of the slider device 150'. The angle of the bottom edges 164', 165' relative to the horizontal remains the same as the angle of the bottom edges 164, 165 of FIG. 4 relative to the horizontal. By reducing the relative angle between the top edges 162', 163' and the bottom edges 164', 165', respectively, the distance the sidewalls 151', 152' of the slider device 150' can travel outward away from the closure profiles 130, 131 (FIG. 4) has been reduced, as compared to the embodiment of FIG. 4.

Figure 6:
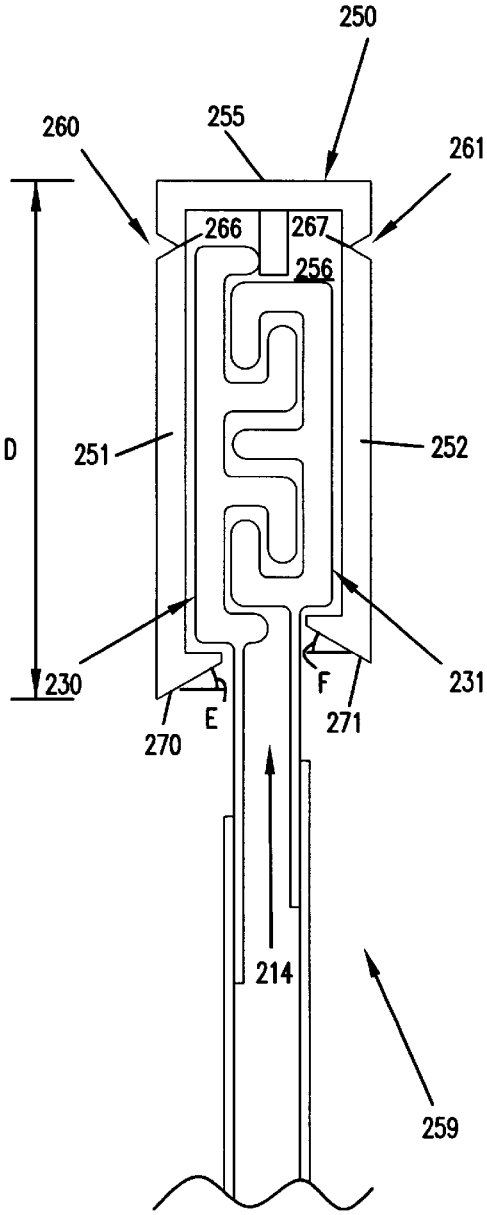
FIG. 6 is a fragmented, back elevational view of another alternate embodiment of a slider device engaging interlocked profiled elements, according to an example embodiment of the present invention.

Attention is directed to FIG. 6. FIG. 6 is a back elevational view of another embodiment of a slider device 250. In this embodiment, a flexibility system 259 includes first and second notches 260, 261 defined by the first and second sidewalls 251, 252, respectively. In this particular embodiment, the first and second notches 260, 261 are located on the outside, or opposite the cavity 256, of the sidewalls 251, 252 towards the top wall 255 of the slider device 250. The first and second notches 260, 261 have structure analogous to the first and second notches 160, 161 of FIG. 4.

The first and second notches 260, 261 form flex points 266, 267, respectively, in the sidewalls 251, 252, respectively. The flex points 266, 267 allow the respective sidewalls 251, 252 to flex or bend. During assembly of the slider device 250 onto the closure mechanism 114 of the package 110 (FIG. 1), the sidewalls 251, 252 are pushed outward and away from each other, flexing at flex points 266, 267, to allow the slider device 250 to be placed over the first and second closure profiles 230, 231. Once the slider device 250 is in place, the sidewalls 251, 252 revert back to their natural position, approximately normal to the top wall 255 of the slider device 250.

To further aid in assembly of the slider device 250 onto the closure to mechanism 214, a bottom edge 270 of the first sidewall 251 is angled upward a first angle E from a line parallel with the top wall 255 of the slider device 250. Likewise, a bottom edge 271 of the second sidewall 252 is angled upward a second angle F from a line parallel with the top wall 255 of the slider device 250. Preferably the first and second angles E, F are approximately equal, about 45 degrees. The angled bottom edges 270, 271 deflect the sidewalls 251, 252 outward when the slider device 250 is pushed onto the closure profiles 230, 231.

Figure 7:
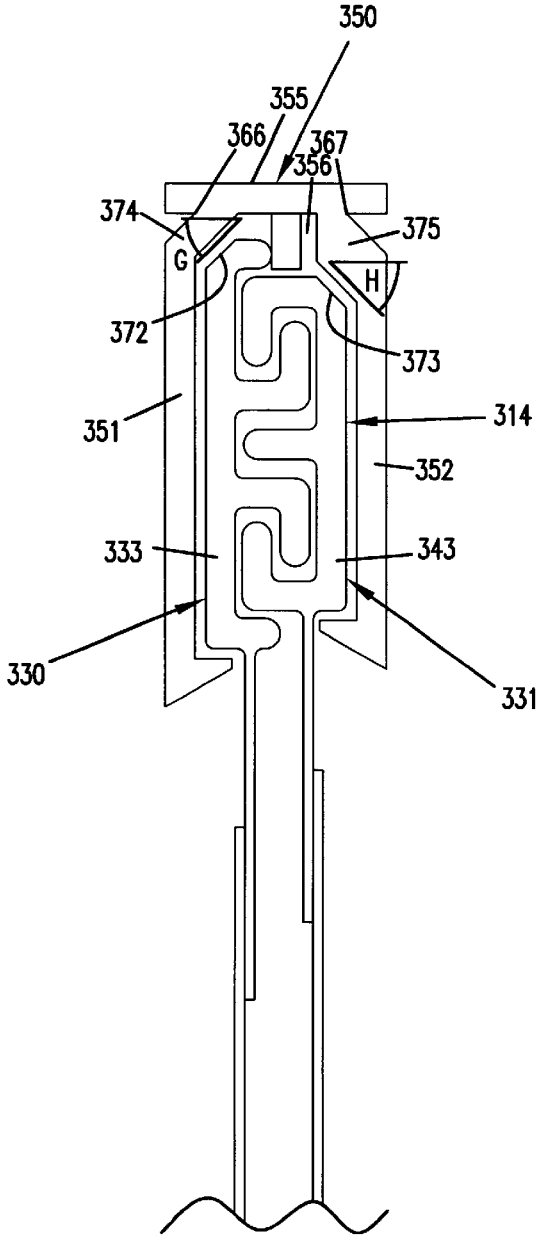
FIG. 7 is a fragmented, back elevational view of another alternate embodiment of a slider device engaging interlocked profiled elements, according to an example embodiment of the present invention.

Attention is directed to FIG. 7. FIG. 7 is a back elevational view of another embodiment of a slider device 350. To further aid in assembly of the slider device 350 over the closure mechanism 314, the base strips 333, 343 of the first and second closure profiles 330, 331, respectively, are angled. A top edge 372 of the base strip 333 of the first closure profile 330 is angled downward a third angle G from a line parallel with the top wall 355 of the slider device 350. Likewise, a top edge 373 of the base strip 343 of the second closure profile 331 is angled downward a fourth angle H from a line parallel with the top wall 355 of the slider device 350. Preferably, the third and fourth angles G, H are approximately equal, for example, about 45 degrees. The angled top edges 372, 373 of the base strips 333, 343 deflect the sidewalls 351, 352 of the slider device 350 out away from the closure profiles 330, 331 when the slider device 350 is pushed onto the closure profiles 330, 331. The sidewalls 351, 352 flex at flexpoints 366, 367 during assembly of the slider device 350 over the closure profiles 330, 331.

Still referring to FIG. 7, the sidewalls 351, 352 are contoured near the top wall 355 of the slider device 350 by angling the tops 374, 375 of the sidewalls 351, 352 to approximate the angles G, H, respectively, of the top edges 372, 373, respectively of the base strips 333, 343, respectively. This contours the cavity 356 to fit the shape of the closure profiles 330, 331, allowing the slider device 350 to be quickly positioned and oriented on the closure profiles 330, 331.

Figure 8:
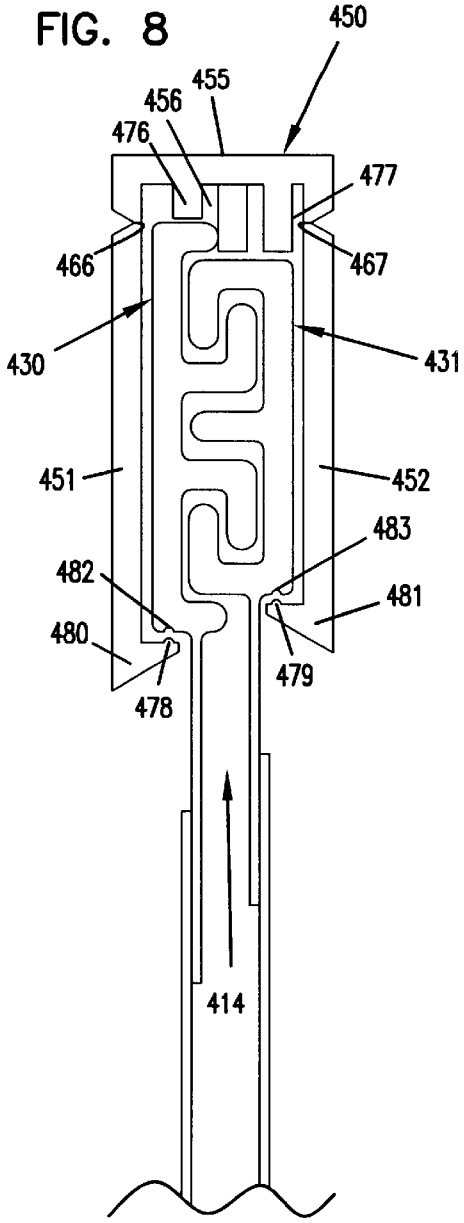
FIG. 8 is a fragmented, back elevational view of another alternate embodiment of a slider device engaging interlocked profiled elements, according to an example embodiment of the present invention.

Attention is directed to FIG. 8. According to another example embodiment of the present invention, the slider device 450 has first and second depending tabs 476, 477 depending from the top wall 455. The first depending tab 476 occupies the area between the top wall 455 of the slider device 450 and the first closure profile 430. Likewise, the second depending tab 477 occupies the area between the top wall 455 of the slider device 450 and the second closure profile 431. The first and second depending tabs 476, 477 contour the cavity 456 of the slider device 450 to fit the shape of the closure profiles 430, 431, allowing the slider device 450 to be quickly positioned and orientated on the closure profiles 430, 431.

The slider device 450 also has elongated projections or guide rails 478, 479 that extend along first and second bottoms 480, 481, respectively. of the first and second sidewalls 451, 452, respectively. The closure profiles 430, 431 also have mating recesses or grooves or guide tracks 482, 483 that extend along the bottom of the closure profiles 430, 431. The guide rails 478,479 slidably fit within and are received by the respective guide tracks 482, 483. By the term "slidably fit," it is meant the guide rails 478, 479 are received within the guide tracks 482, 483 such that they are retained within the guide tracks 482, 483 but also slide along the length of the first and second closure profiles 430, 431 within the guide tracks 482, 483. The guide rails 478, 479 help to guide the slider device 450 along the closure profiles 430, 431. The guide rails 478, 479 also help to maintain the sidewalls 451, 452 approximately normal to the top 455 of the slider device 450 by locking the sidewalls 451, 452 in place under the closure profiles 430, 431. Alternatively, the guide tracks could be located on the slider device 450 and the guiderails could be located on the first and second closure profiles 430, 431.

Figure 9B:
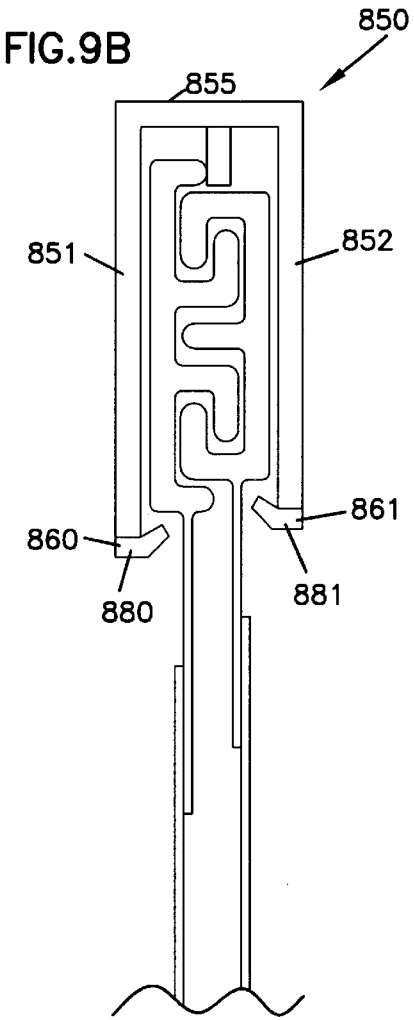
FIG. 9B is a fragmented, back elevational view of another alternative embodiment of a slider device engaging interlocked profile elements, according to an example embodiment of the present invention.
Figure 9A:
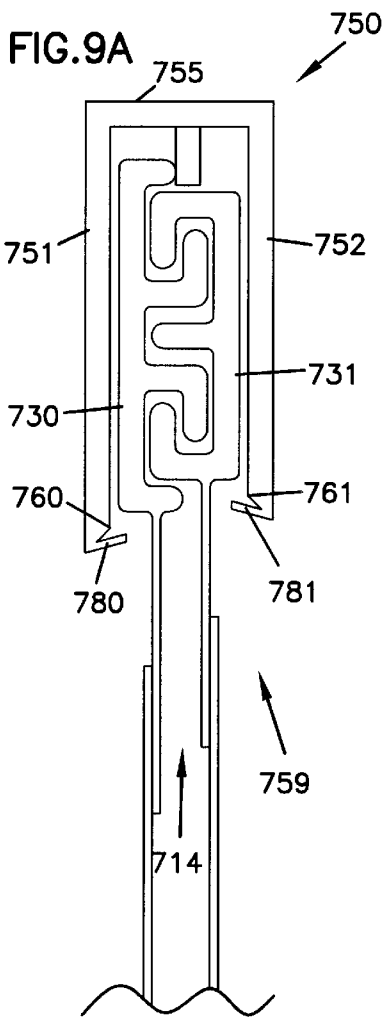
FIG. 9A is a fragmented, back elevational view of another alternative embodiment of a slider device engaging interlocked profile elements, according to an example embodiment of the present invention.
Figure 9:
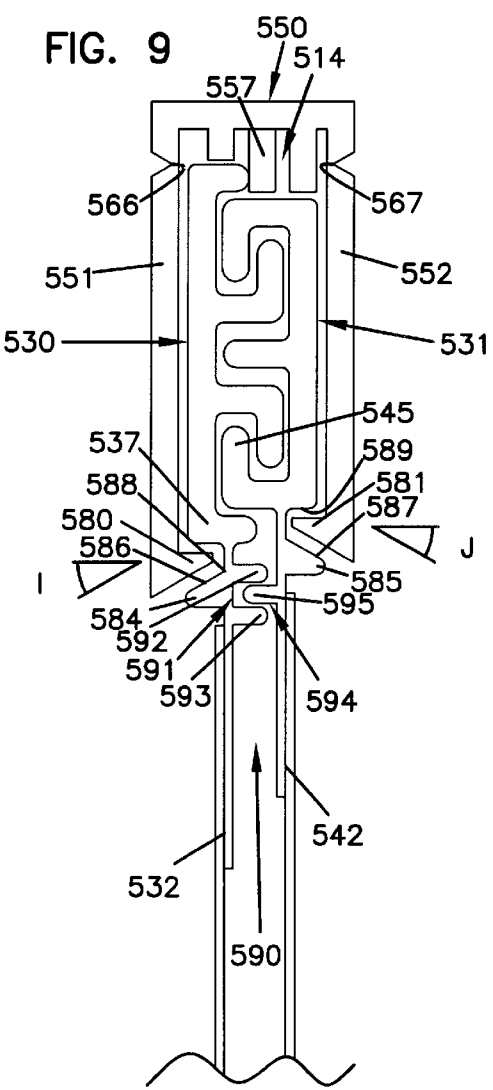
FIG. 9 is a fragmented, back elevational view of another alternate embodiment of a slider device engaging interlocked profiled elements, according to an example embodiment of the present invention.

Attention is directed to FIG. 9. According to another example embodiment of the present invention, the closure profiles 530, 531 have an alignment system for helping to securely retain the slider device 550 over the closure mechanism 514. In the embodiment shown in FIG. 9, the closure profiles 530, 531 include first and second projections or alignment ridges 584, 585 respectively. Preferably, the alignment ridges 584, 585 extend the full length of the closure profiles 530, 531, respectively. The first and second alignment ridges 584, 585 have first and second top edges 586, 587, respectively. The first and second top edges 586, 587 are angled down toward the package 110 (FIG. 1) at fifth and sixth angles I, J, respectively. Preferably, the fifth and sixth angles I, J are approximately equal to the first and second angles E, F (FIG. 6) of the bottoms 580, 581, respectively, of the sidewalls 551, 552, respectively, and are typically 45 degrees.

The first alignment ridge 584 and the second guide post 537 of the first closure profile 530 define a first recess or groove 588. Likewise, the second alignment ridge 585 and the second interlocking closure member 545 of the second closure profile 531 define a second recess or groove 589. The first and second grooves 588, 589 are designed to receive the hooks of the first and second bottoms 580, 581, respectively, of the sidewalls 551, 552, respectively. Correspondingly, the alignment ridges 584, 585 are located on the bonding strips 532, 542 of the first and second closure profiles 530, 531, respectively, such that the first and second grooves 588, 589 receive the bottoms 580, 581 of the sidewalls 551, 552, respectively. The alignment ridges 584, 585 help to maintain the slider device 550 securely retained to or locked over the closure profiles 530, 531.

The first and second closure profiles 530, 531 also have a secondary closure arrangement for providing a supplemental, or back-up, seal to ensure fluid-tightness and a leakless closure. One example embodiment is shown in FIG. 9 as a secondary closure mechanism 590. In particular, the bonding strip 532 of the first closure profile 530 has a first profiled member 591. The first profiled member 591 has first and second closure ridges 592, 593. The bonding strip 542 of the second closure profile 531 has a second profiled member 594. The second profiled member 594 has a first closure ridge 595. The closure ridges 592, 593, 595 project out from their respective bonding strips 532, 542. The closure ridges 592, 593, 595 are located below the primary closure mechanism 514 and the slider device 550. By the term "below," it is meant that the secondary closure mechanism 590 is located more toward the interior 124 (FIG. 1) of the package 110 (FIG. 1) than the primary closure mechanism 514 or the slider device 550. In other words, the secondary closure mechanism 590 is located between the primary closure mechanism 514 and the bottom edge 125 (FIG. 1) of the package 110 (FIG. 1). The first and second closure ridges 592, 593 of the first closure profile 530 are designed to receive the first closure ridge 595 of the second closure profile 531. The first closure ridge 595 of the second closure profile 531 fits tightly or snugly within the first and second closure ridges 592, 593 of the first closure profile 530, such that a leakproof secondary closure mechanism 590 is formed.

Sometimes, in some embodiments, the plow 557 of the slider device 550 may keep the first and second closure profiles 530, 531 from completely engaging along the entire length of the primary closure mechanism 514 when the slider device 550 is in the closed position. Referring to FIG. 1, by the term "closed position," it is meant that the slider device has traveled in the sealing direction A and has come to rest proximate to the side edge 122 of the package 110. In this position, the plow 557 (FIG. 9) may keep the first and second closure profiles 530, 531 (FIG. 9) from engaging near the side edge 122 of the package 110. Referring back to FIG. 9, the secondary closure mechanism 590 is designed to ensure that the mouth 126 of the package 110 of FIG. 1 is leak-proof even though the primary closure mechanism 514 may not be completely sealed in the closed position. Alternatively, the secondary closure mechanism 590 may be any single or multi-track zipper-type closure mechanism.

The first and second profiled elements 591, 594 and the first and second alignment ridges 584, 585 are extruded from a first material along with the first and second closure profiles 530, 531. The first material is preferably a polymer. plastic material that provides enough rigidity to seal the secondary closure mechanism 590 along with the primary closure mechanism 514. In other words, the first material is rigid enough that when the slider device 550 slides along the first and second closure profiles 530, 531 in the sealing direction A (FIG. 1), the slider device 550 engages the first and second closure profiles 530, 531 of the primary closure mechanism 514 as well as causes the first and second profiled elements 591, 594 of the secondary closure mechanism 590 to interlock.

Alternatively, the first and second profiled elements 591, 594 may be coextruded with the first and second closure profiles 530, 531, using a second material for the first and second profiled elements 591, 594 that is different from the first material used for the remaining portion of the first and second closure profiles 530, 531. For example, the first and second profiled elements 591, 594 may be coextruded from a polymer, plastic material that is softer or tackier than the first material used for the remaining portion of the first and second closure profiles 530, 531. The softer or tackier second material would help to improve the seal of the secondary closure mechanism 590.

Attention is directed to FIG. 9A. FIG. 9A is a back elevational view of another example embodiment of a slider device 750. In this embodiment, a flexibility system 759 includes first and second bottoms 780, 781. Preferably, the first and second bottoms 780, 781 comprise a thinner, flexible material than the sidewalls 751, 752 of the slider device 750. The thinner, flexible material allows the first and second bottoms 780, 781 to deflect toward the top 755 of the slider device 750, while the sidewalls 751, 752 remain rigid during installation. During installation. after the slider device 750 has been installed on the closure mechanism 714 and the bottoms 780, 781 are beyond the first and second closure profiles 730 731, respectively, the bottoms 780, 781 return to their normal position as shown in FIG. 9A.

The flexibility system 759 can also have first and second notches 760, 761. The notches 760, 761 further aid in deflecting the bottoms 780, 781 during installation of the slider device 750. The notches 760, 761 are analogous to the notches 160, 161 of FIG. 4.

Attention is directed to FIG. 9B. FIG. 9B is a back elevational view of another example embodiment of a slider device 850. In this embodiment, the first and second bottoms 880, 881 are coextruded from a first material 860, different than that of the remainder of the slider device 850, which is extruded from a second material 861. The first material 860 is a more flexible material than the second material 861. During installation, the bottoms 880, 881, comprising the flexible first material 860, will deflect toward the top 855 of the slider device 850, while the sidewalls 851, 852, comprising the second material 861, remain rigid.

Figure 10A:
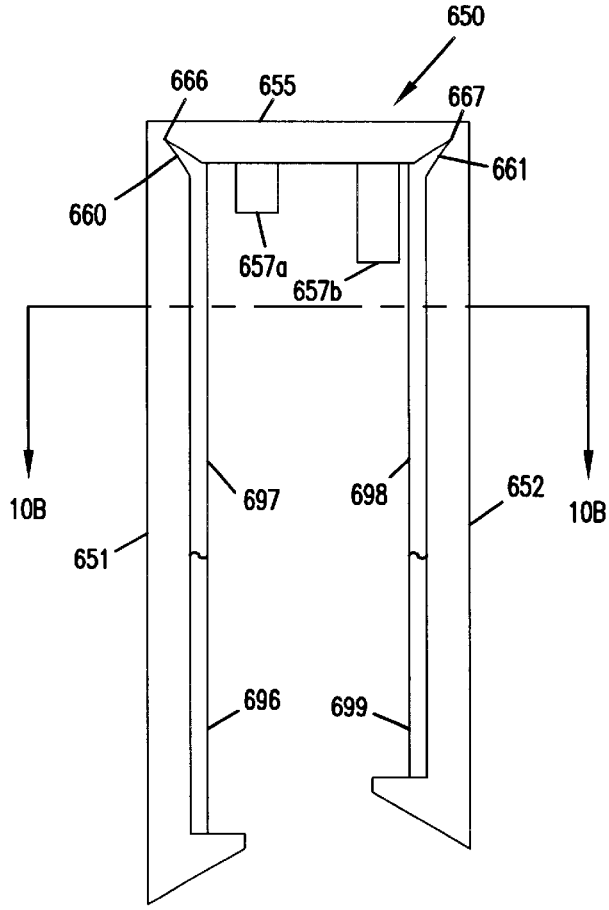
FIG. 10A is a fragmented, back elevational view of another alternate embodiment of a slider device, according to an example embodiment of the present invention.

Attention is directed to FIG. 10A. According to another example embodiment, a slider device 650 has a first plow 657*a* and a second plow 657*b*. The first and second plows 657*a*, 657*b* have structure analogous to the plow 157 of the slider device 150 of FIG. 3. In some applications, the first and second plows 657*a*, 657*b* separate the closure profiles 130, 131 (FIG. 2) more efficiently than a single plow 157 (FIG. 3). Whether a single plow 157, as in FIG. 3. is used, or whether multiple plows 657*a*, 657*b*, as in FIG. 10A, are used, is dependent on the type of closure mechanism that is utilized.

Still in reference to FIG. 10A, the slider device 650 has first and second notches 660, 661. The first and second notches 660, 661 have structure analogous to the first and second notches 160, 161 of FIG. 4. In embodiment illustrated in FIG. 10A, the first and second notches 660, 661 are located between the rigid top wall 655 and the first and second sidewalls 651, 652. The first and second notches 660, 661 create first and second flex points 666, 667. The first and second flex points 666, 667 are analogous to the first and second flex points 166, 167 of FIG. 4, allowing the sidewalls 651, 652 to flex apart.

Figure 10B:
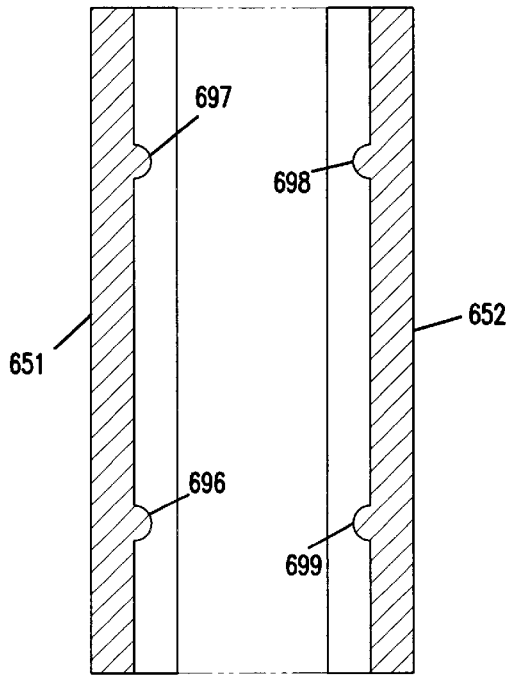
FIG. 10B is a cross-sectional view of the slider device depicted in FIG. 10A, taken along the line 10B—10B of FIG. 10A.

The slider device 650 also has a plurality of surface ridges for reducing the force needed to move the slider device 650 in the sealing and opening directions A, B along the top edge 127 of the package 110 of FIG. 1. Preferably, as illustrated in FIG. 10B, the slider device 650 has a first bump or surface ridge 696, a second surface ridge 697, a third surface ridge 698, and a fourth surface ridge 699. The surface ridges 696, 697, 698, 699 come in contact with the closure profiles 130, 131 (FIG. 2), respectively. The surface ridges 696, 697, 698, 699 reduce the contact area between the closure profiles 130, 131 and the surface ridges 696, 697, 698, 699, reducing the friction and resulting force necessary to move the slider device 650 in the sealing and opening directions A, B along the top edge 127 of the package 110 of FIG. 1. Alternatively, the slider device 650 only has the first surface ridge 696 and the fourth surface ridge 699 or has more than four surface ridges. In another variation, one or more continuous or discontinuous ribs or ridges extend at an angle to the horizontal, such as vertically, to reduce the contact area with the closure profiles.

Figure 11:
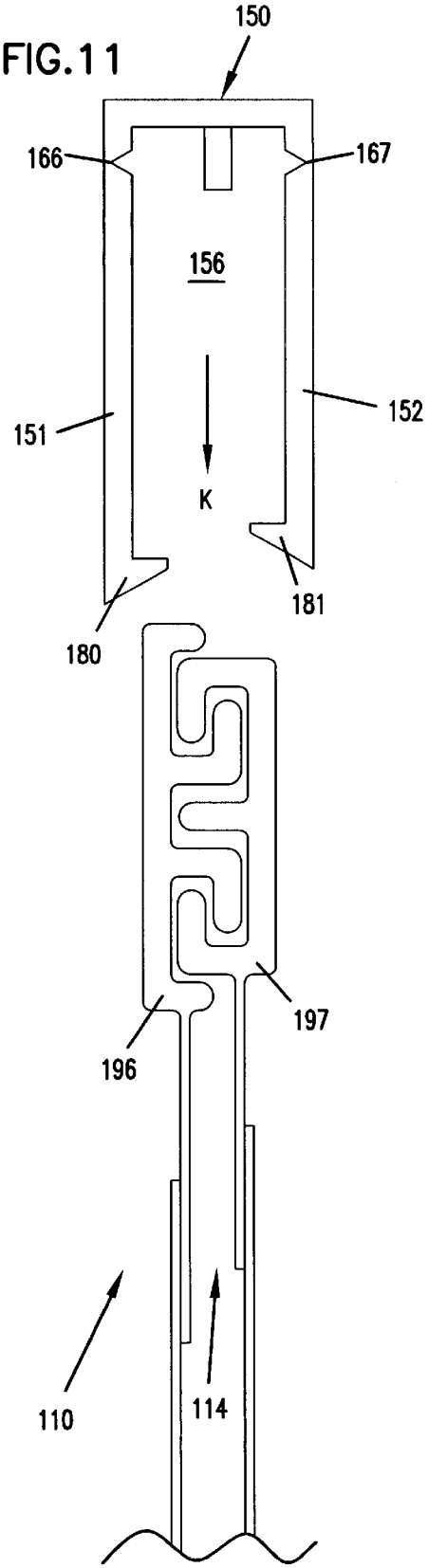
FIG. 11 is a schematic, exploded view illustrating one step of the slider device of FIG. 3 being assembled onto the package of FIG. 1, according to an example embodiment of the present invention.

Attention is directed to FIG. 11. FIG. 11 illustrates schematically one of the steps in assembly of the slider device 150 onto the closure mechanism 114. Generally, after manufacturing, the package 110 has an interlocked resealable closure mechanism 114. The slider device 150 is oriented such that the cavity 156, defined by the sidewalls 151, 152. is above and aligned with the resealable closure mechanism 114.

Figure 12:
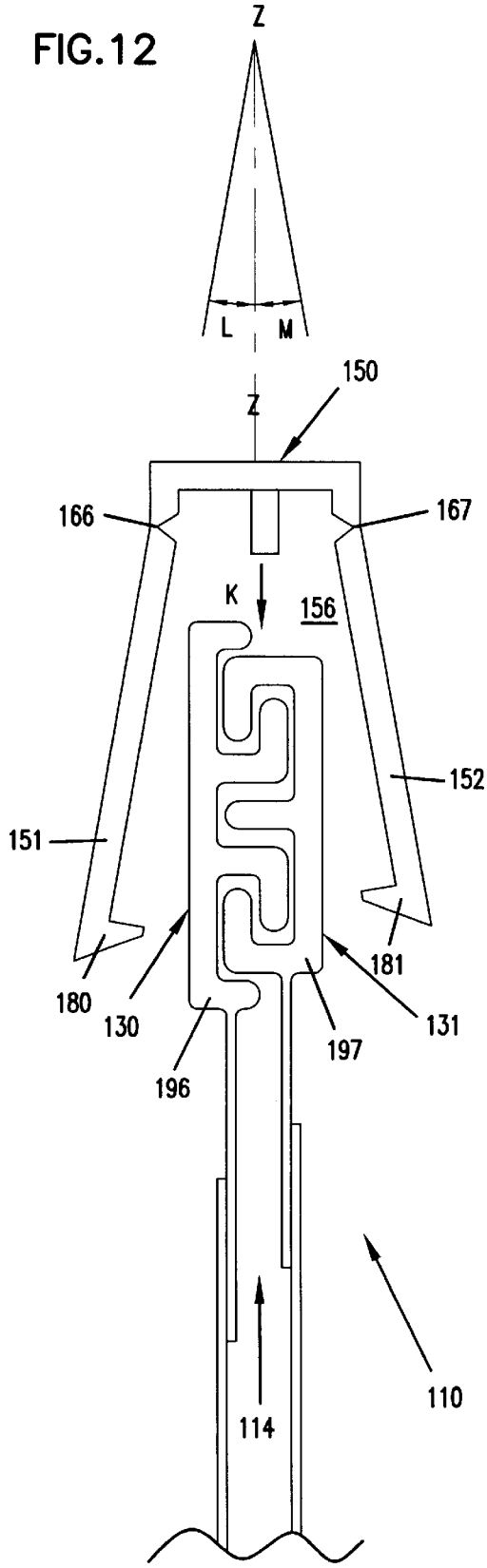
FIG. 12 is a schematic, exploded view illustrating another step of the slider device of FIG. 3 being assembled onto the package of FIG. 1, according to an example embodiment of the present invention.

Attention is directed to FIG. 12. FIG. 12 is an illustration of another step of the assembly process. The slider device 150 is pushed down toward the closure mechanism 114 in the direction of arrow K, causing the sidewalls 151, 152 to flex at flex points 166, 167, spreading the sidewalls 151, 152 apart. The first sidewall 151 deflects from a center line Z of the slider device 150 a seventh angle L. Likewise, the second wall 152 deflects from the center line Z of the slider device 150 an eighth angle M. The sizes of the seventh and eighth angles L, M are dependent on the length of the sidewalls 151, 152. Preferably the seventh and eighth angles L, M are less than approximately 30 degrees.

Referring back to FIG. 4. after the closure profiles 130, 131 are within the cavity 156, the sidewalls 151, 152 snap back into their natural position, approximately normal to the top wall 155 of the slider device 150. Note that the bottoms 180, 181 of the sidewalls 151, 152 hook over and engage the bottoms 196, 197 of the profiles 130, 131 to help lock the slider 150 to the closure mechanism 114. The slider device 150 then operates as described previously herein.

The steps of assembly of the slider device 150 over the closure profiles 130, 131, while shown for the slider device embodiment of FIGS. 3 and 4, are analogous to the other embodiments of the slider device.

The above specification and examples are believed to provide a complete description of the manufacture and use of particular embodiments of the invention. Many embodiments of the invention can be made without departing from the spirit and scope of the invention.

I claim:

1. A single-piece slider device for use with a resealable closure mechanism having a first closure profile and a second closure profile, the slider device comprising:

(a) a rigid top wall;

(b) at least a first plow depending from the top wall for separating the first and second closure profiles;

(c) a first sidewall having a first inner surface, a first outer surface, a first bottom edge, and a first length; the first sidewall having a first flex point arranged and configured to allow a first portion of the first sidewall to flex at the first flex point; and (d) a second sidewall having a second inner surface, a second outer surface, a second bottom edge, and a second length; the second sidewall having a second flex point arranged and configured to allow a first portion of the second sidewall to flex at the second flex point;

wherein the first bottom edge of the first sidewall is angled upward toward the top wall of the slider device at a first angle relative to a line parallel with the top wall of the slider device, and the second bottom edge of the second sidewall is angled upward toward the top wall of the slider device at a second angle relative to the line parallel with the top wall of the slider device.

2. A slider device according to claim 1, wherein the first flex point is located on the first inner surface of the first sidewall, and the second flex point is located on the second inner surface of the second sidewall.

3. A slider device according to claim 2, wherein the first sidewall defines a first notch arranged and configured to create the first flex point, and the second sidewall defines a second notch arranged and configured to create the second flex point.

4. A slider device according to claim 1, wherein the first flex point is located on the first inner surface of the first sidewall, and the second flex point is located on the second inner surface of the second sidewall.

5. A slider device according to claim 4, wherein the first sidewall defines a first notch arranged and configured to create the first flex point, and the second sidewall defines a second notch arranged and configured to create the second flex point.

6. A slider device according to claim 5, wherein the first notch has a triangular shape having a first top edge and a first bottom edge, and the second notch has a triangular shape having a second top edge and a second bottom edge.

7. A slider device according to claim 6, wherein the first top edge of the first notch and the second top edge of the second notch are parallel with the top wall of the slider device.

8. A slider device according to claim 1, wherein the first flex point is located on the first outer surface of the first sidewall, and the second flex point is located on the second outer surface of the second sidewall.

9. A slider device according to claim 1, wherein the first flex point is located between the first sidewall and the top wall, and the second flex point is located between the second sidewall and the top wall.

10. A slider device according to claim 9, wherein the first sidewall and the top wall define a first notch arranged and configured to create the first flex point, and the second sidewall and the top wall define a second notch arranged and configured to create the second flex point.

11. A slider device according to claim 1, wherein the first flex point is located between the first sidewall and a first bottom portion of the first sidewall and the second flex point is located between the second sidewall and a second bottom portion of the second sidewall.

12. A slider device according to claim 11, wherein the first and second bottom portions are coextruded with the first and second sidewalls.

13. A slider device according to claim 1, wherein the slider device is contoured to provide at least a first grasping region for a consumer to operate the slider device.

14. A slider device according to claim 13, wherein the first flex point is rigid and configured to snap back to a first sidewall initial position; and the second flex point is rigid and configured to snap back to a second sidewall initial position.

15. A slider device according to claim 1, wherein the rigid top wall of the slider device has at least a first tab depending down into the cavity of the slider device.

16. A slider device according to claim 1, further comprising a second plow depending from the top wall for separating the first and second closure profiles.

17. A slider device according to claim 1, further comprising a plurality of surface ridges extending from the first inner surface of the first sidewall and the second inner surface of the second sidewall.

18. A single-piece slider device for use with a resealable closure mechanism having a first closure profile and a second closure profile, the slider device comprising:

(a) a rigid top wall;

(b) at least a first plow depending from the top wall for separating the first and second closure profiles;

(c) a first sidewall having a first inner surface, a first outer surface, a first bottom edge, and a first length; the first sidewall having a first flex point arranged and configured to allow a first portion of the first sidewall to flex at the first flex point; and (d) a second sidewall having a second inner surface, a second outer surface, a second bottom edge, and a second length; the second sidewall having a second flex point arranged and configured to allow a first portion of the second sidewall to flex at the second flex point; and further comprising at least a first window in the top wall.

19. A slider device according to claim 18 wherein the first flex point is located on the first inner surface of the first sidewall, and the second flex point is located on the second inner surface of the second sidewall.

20. A slider device according to claim 19, wherein the first sidewall defines a first notch arranged and configured to create the first flex point, and the second sidewall defines a second notch arranged and configured to create the second flex point.

21. A slider device according to claim 20, wherein the first notch has a triangular shape having a first top edge and a first bottom edge, and the second notch has a triangular shape having a second top edge and a second bottom edge.

22. A slider device according to claim 18 wherein the first flex point is rigid and configured to snap back to a first sidewall initial position; and the second flex point is rigid and configured to snap back to a second sidewall initial position.

23. A slider device according to claim 18, wherein the first flex point is located on the first outer surface of the first sidewall, and the second flex point is located on the second outer surface of the second sidewall.

24. A slider device according to claim 18, wherein the rigid top wall of the slider device has at least a first tab depending down into the cavity of the slider device.

25. A slider device according to claim 18, further comprising a plurality of surface ridges extending from the first inner surface of the first sidewall and the second inner surface of the second sidewall.

26. A slider device according to claim 18 wherein the first bottom edge of the first sidewall is angled upward toward the top wall of the slider device at a first angle relative to a line parallel with the top wall of the slider device, and the second bottom edge of the second sidewall is angled upward toward the top wall of the slider device at a second angle relative to the line parallel with the top wall of the slider device.

27. A single-piece slider device for use with a resealable closure mechanism having a first closure profile and a second closure profile, the slider device comprising:

(a) a rigid top wall;

(b) at least a first plow depending from the top wall for separating the first and second closure profiles;

(c) a first sidewall having a first inner surface, a first outer surface, a first bottom edge, and a first length; the first sidewall having a first flex point arranged and configured to allow a first portion of the first sidewall to flex outwardly from a first sidewall initial position normal to the top wall at the first flex point responsive to a first force;

(i) the first flex point being rigid and configured to snap back to the first sidewall initial position upon release of the first force; and (d) a second sidewall having a second inner surface, a second outer surface, a second bottom edge, and a second length; the second sidewall having a second flex point arranged and configured to allow a first portion of the second sidewall to flex outwardly from a second sidewall initial position normal to the top wall at the second flex point responsive to a second force;

(i) the second flex point being rigid and configured to snap back to the second sidewall initial position upon release of the second force;

wherein the first bottom edge of the first sidewall is angled upward toward the top wall of the slider device at a first angle relative to a line parallel with the top wall of the slider device, and the second bottom edge of the second sidewall is angled upward toward the top wall of the slider device at a second angle relative to the line parallel with the top wall of the slider device.

28. A slider device according to claim 27 wherein the first flex point is located on the first inner surface of the first sidewall, and the second flex point is located on the second inner surface of the second sidewall.

29. A slider device according to claim 27, wherein the first flex point is located on the first outer surface of the first sidewall, and the second flex point is located on the second outer surface of the second sidewall.

30. A slider device according to claim 27, wherein the first flex point is located between the first sidewall and the top wall, and the second flex point is located between the second sidewall and the top wall.

31. A slider device according to claim 27, wherein the first flex point is located between the first sidewall and a first bottom portion of the first sidewall and the second flex point is located between the second sidewall and a second bottom portion of the second sidewall.

32. A slider device according to claim 27, wherein the slider device is contoured to provide at least a first grasping region for a consumer to operate the slider device.

* * * * *

UNITED STATES PATENT AND TRADEMARK OFFICE

CERTIFICATE OF CORRECTION

PATENT NO. : 6,306,071 B1
DATED : October 23, 2001
INVENTOR(S) : Mladomir Tomic

It is certified that error appears in the above-identified patent and that said Letters Patent is hereby corrected as shown below:

Column 12,
Line 64-67, "flex point is located on the first inner surface of the first sidewall, and the second flex point is located on the second inner surface of the second sidewall." should read -- and second angles are approximately equal. --.

Column 13,
Lines 1-5, "sidewall defines a first notch arranged and configured to create the first flex point, and the second sidewall defines a second notch arranged and configured to create the second flex point." should read -- and second angles are approximately 45 degrees. --.

Signed and Sealed this

Second Day of September, 2003

JAMES E. ROGAN
*Director of the United States Patent and Trademark Office*